US011029124B2

(12) United States Patent
Call

(10) Patent No.: US 11,029,124 B2
(45) Date of Patent: Jun. 8, 2021

(54) MULTI-SHOT AIRGUN

(71) Applicant: Crosman Corporation, Bloomfield, NY (US)

(72) Inventor: Kenneth Call, Henrietta, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 16/746,597

(22) Filed: Jan. 17, 2020

(65) Prior Publication Data

US 2020/0232749 A1 Jul. 23, 2020

Related U.S. Application Data

(60) Provisional application No. 62/793,887, filed on Jan. 17, 2019.

(51) Int. Cl.
*F41B 11/55* (2013.01)

(52) U.S. Cl.
CPC ..... *F41B 11/55* (2013.01)

(58) Field of Classification Search
CPC ..... F41B 11/55; F41B 11/50; F41B 11/62; F41B 11/648; F41B 11/70; F41A 3/58
See application file for complete search history.

(56) References Cited

U.S. PATENT DOCUMENTS 578,820 A * 3/1897 Hornhauer ..... F41B 11/647 124/67
891,211 A * 6/1908 Driver et al. ..... F41B 11/50 124/82
2,194,142 A * 3/1940 Foss ..... F41B 11/648 124/67
2,572,176 A * 10/1951 Mihalyi ..... F41B 11/648 124/67
3,908,626 A * 9/1975 Hammond ..... F41B 11/648 124/67
3,924,599 A * 12/1975 Hammond ..... F41B 11/648 124/67
4,367,723 A * 1/1983 Resuggan ..... F41B 11/646 124/67
4,774,929 A * 10/1988 Milliman ..... F41B 11/648 124/76
4,883,042 A * 11/1989 Wackrow ..... F41B 11/646 124/67
5,160,795 A * 11/1992 Milliman ..... F41A 19/53 124/48
5,205,271 A * 4/1993 Casas Salva ..... F41B 11/00 124/65
5,285,766 A * 2/1994 Milliman ..... F41B 11/54 124/48
5,341,790 A * 8/1994 Ebert ..... F41B 11/62 124/69

(Continued)

*Primary Examiner* — Benjamin P Lee
(74) *Attorney, Agent, or Firm* — Lee & Hayes, P.C.

(57) ABSTRACT

Break barrel airguns are provided with a loading system that uses the cocking action of the break barrel type airgun to load projectiles from a magazine held by a magazine holder into a shuttle system that is positioned by the magazine holder during loader and moved to a position aligned with the barrel during firing. The loading system has a resilient barrier between the magazine holder and the shuttle that reduces the risks of loading errors caused by adhesion between the bolt and a pellet.

6 Claims, 14 Drawing Sheets

(56) References Cited

U.S. PATENT DOCUMENTS 5,570,676 A * 11/1996 Gore ..... F41B 11/642 124/56
5,575,270 A * 11/1996 Casas-Salva ..... F41B 11/648 124/67
5,632,264 A * 5/1997 Barker ..... F41B 11/648 124/67
5,655,509 A * 8/1997 Casas Salva ..... F41B 11/648 124/66
6,539,659 B2 * 4/2003 Casas Salva ..... F41C 7/11 42/75.04
9,903,676 B2 * 2/2018 Calvete ..... F42B 5/38
9,995,556 B2 * 6/2018 Hall ..... F41C 23/16
10,197,355 B2 * 2/2019 Lamboy ..... F41B 11/683
10,267,593 B2 * 4/2019 Lamboy ..... F41B 11/54
10,288,375 B2 * 5/2019 Spreadbury, III ..... F41B 11/648
10,386,154 B2 * 8/2019 Kras ..... F41B 11/684
2006/0064911 A1 * 3/2006 Lewis ..... F41B 11/648 42/54
2010/0229844 A1 * 9/2010 Gore ..... F41B 11/642 124/80
2013/0247438 A1 * 9/2013 Torre ..... F41A 3/66 42/75.03
2016/0273872 A1 * 9/2016 Steele ..... F41C 9/085
2017/0089664 A1 * 3/2017 Kras ..... F41B 11/62
2018/0031349 A1 * 2/2018 Malheiros ..... F41B 11/648
2018/0252492 A1 * 9/2018 Spreadbury, III ..... F41B 11/648
2018/0252493 A1 * 9/2018 Heckert ..... F41B 11/648
2019/0204046 A1 * 7/2019 Calvete ..... F41A 3/58
2020/0232749 A1 * 7/2020 Call ..... F41B 11/648

* cited by examiner

MULTI-SHOT AIRGUN

CROSS REFERENCE TO RELATED APPLICATIONS

This application claims the benefit of U.S. Provisional Patent Application No. 62/793,887, filed on Jan. 17, 2019.

STATEMENT REGARDING FEDERALLY SPONSORED RESEARCH OR DEVELOPMENT

N/A

REFERENCE TO SEQUENCE LISTING, A TABLE, OR A COMPUTER PROGRAM LISTING COMPACT DISC APPENDIX

N/A

FIELD OF THE INVENTION

This invention relates to airguns of the break barrel type.

BACKGROUND OF THE INVENTION

Conventional break barrel air guns provide a stock and receiver that are joined to a barrel by way of a hinge. The receiver houses a spring into which energy is stored, a trigger for releasing the stored energy of the spring to drive a piston into a compression tube having a transfer port that communicates pressure from the compression tube to a breech end of the barrel. In such air guns, the barrel is hingedly joined to the receiver. When the user wishes to use the break barrel airgun, the user rotates the barrel relative to the stock and receiver. This separates the breech end of the barrel from the transfer port allowing a pellet to be loaded therein. After loading the user rotates the barrel to a position where the breech end of the barrel is positioned proximate to the transfer port. The barrel is also connected to the spring in a manner that causes the energy to be stored in the spring as the break barrel is moved during the loading process.

While the acts of rotating the barrel to and from the loading position can be conducted rather quickly. The process of manually loading an individual pellet into the breech end of a barrel while holding an air rifle can be challenging and can extend the time between shots significantly.

What is needed is a break barrel airgun that can load pellets automatically during the cocking action. This need is particularly challenging to meet in that the cocking action of a break barrel rifle separates the barrel from the breech and loading must therefore occur during such separation.

This need has been long felt and efforts have been made to meet this need by using elevator systems that receive a projectile from a magazine using a loading mechanism located above the bore axis of a barrel bore to load a projectile into an elevator that is lowered into the air gun to form a segment of a path between a tube transfer port and the bore of an airgun. Examples of such approaches are shown in U.S. Pat. No. 5,722,382, entitled "Loading Plate for a Repeat-Air Rifle for Pellets and Ammunition" issued Orozco, on Mar. 3, 1998 and ES1007337U, entitled, in translation "Charging Mechanism for Compressed Air Carabines".

It will be appreciated that such elevator type systems require that the projectile be loaded perfectly within a length of the elevator to prevent the projectile from jamming the elevator as the projectile is lowered into general alignment with the axis of the barrel bore. Further, misalignment of the elevators with the axis of the bore can cause portions of a projectile to impact edges of the barrel leading to variations in projectile geometries if fired from the rifle and may also lead to jamming. Additionally, such solutions involve firing compressed air through the elevator. To avoid loss of energy in an elevator type system, two seals must be maintained during firing one between the elevator and the transfer port and the other between the elevator and the bore of the barrel. These seals must be arranged release during cocking to allow the barrel to tilt away and elevator to shuttle between a firing position and a loading position during cocking and to return to a sealed position for firing. However, such approaches add cost, weight, and complexity which may not be useful in field environments.

Efforts to address these challenges include providing user adjustment controls to help establish and maintain proper alignment between the elevator and the bore have been described in GB978,502 entitled "Improvements in or relating to Air or Gas Pressure Guns" issued to Vesely, et al., and published on Dec. 23, 1964. However, this approach requires constant adjustments and creates usability problems.

These and other challenges have made it difficult to provide a break barrel rifle having a shoot-through elevator type loading system that can achieve a high rate of accurate fire.

BRIEF SUMMARY OF THE INVENTION

In one aspect, an airgun is provided having a tube fork having front face with a port from which a compressed gas can flow, a barrel having a passageway through the barrel with an opening at a back barrel face with the passageway sized to receive a projectile and a pivot joining the barrel to the tube fork such that the barrel can be moved between a firing position where the opening is positioned to receive compressed gas and a cocking position. Also provided are a sled movable between a forward position and a retracted position and a mechanism converting pivotal motion of the barrel relative to the fork into forces urging the sled to move toward the retracted position as the tube fork and the barrel move toward the firing position and into other forces that urge the sled to move toward the forward position as the tube fork and the barrel are rotated toward the cocking position. A magazine holder is adapted to position a magazine so that the bolt passes through a first opening in the magazine holder through magazine to drive a projectile from the magazine, through a second opening in the magazine holder as the bolt moves from the retracted position to the forward position. A shuttle system is adapted to move a projectile channel between a firing location sufficiently aligned with the barrel opening and the port to allow compressed air from the port to drive a projectile through the passageway and a loading location aligned with the second opening to allow the bolt to advance a projectile into the projectile channel. A resilient barrier at the second opening has an opening with at least one opening flap portion that is configured with a resilient bias that is defined so that opening flap portion applies sufficient force against a portion of pellet to overcome any adhesion between bolt and pellet as bolt is moved from the forward position toward the retracted position so as to hold the pellet within the shuttle.

DESCRIPTION OF THE INVENTION

Figure 1:
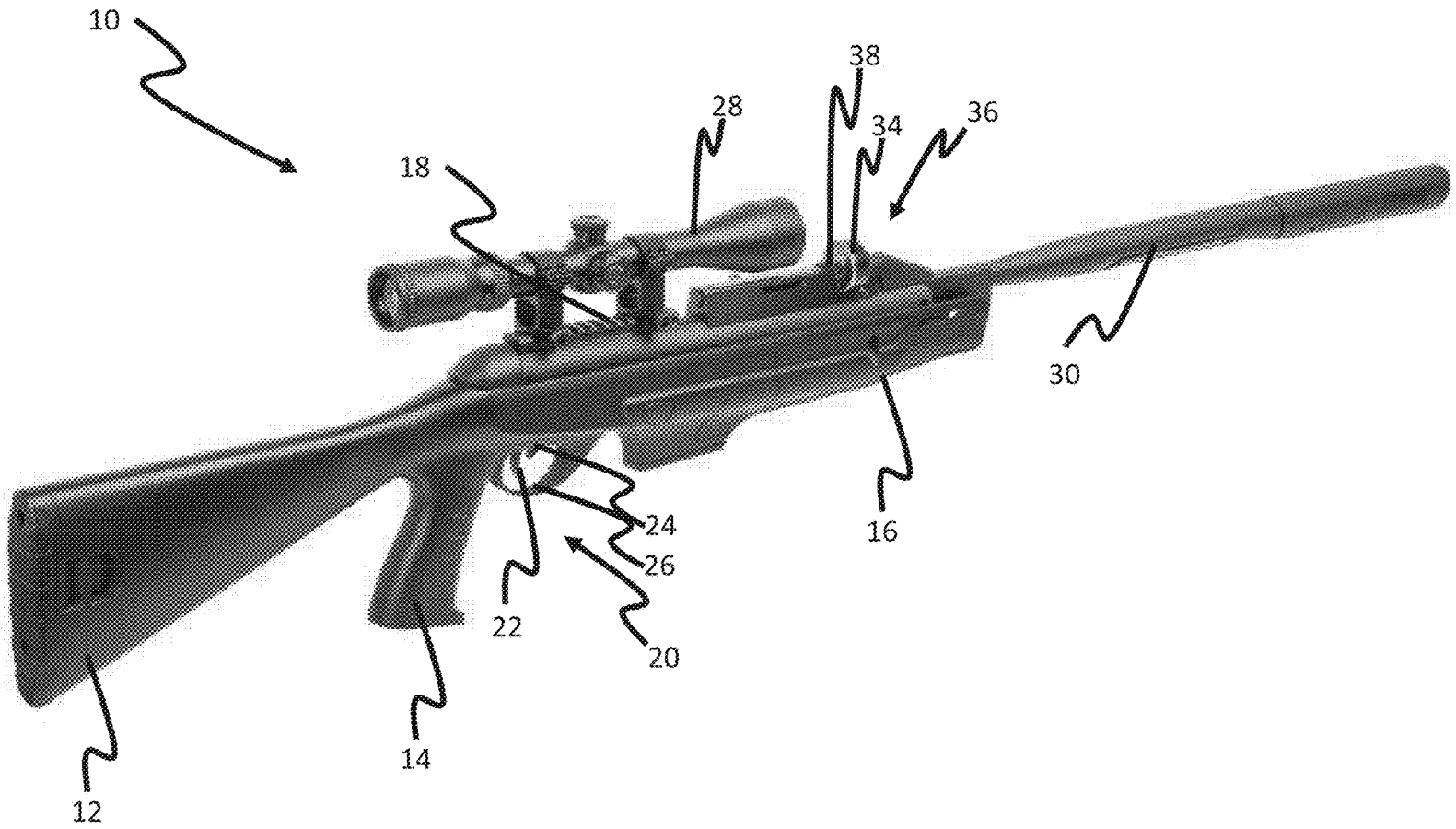
FIG. 1 is a back, right, top perspective view of a rifle of one embodiment of the invention in a firing position.

FIG. 1 is a back, right, top perspective view of a rifle of one embodiment of the invention in a firing position. As is shown in FIG. 1, air gun 10 has stock 12 with a grip handle 14, forestock 16 and mounting rail 18, having an optional scope 28, a trigger system 20, with a trigger 22, a safety 24 and trigger guard 26. Airgun 10 also has a barrel 30 through which projectiles (not shown) such as pellets are thrust toward a target. In this embodiment a loading system 36 holds a magazine 34 containing a plurality of projectiles in a magazine holder 38.

Figure 2:
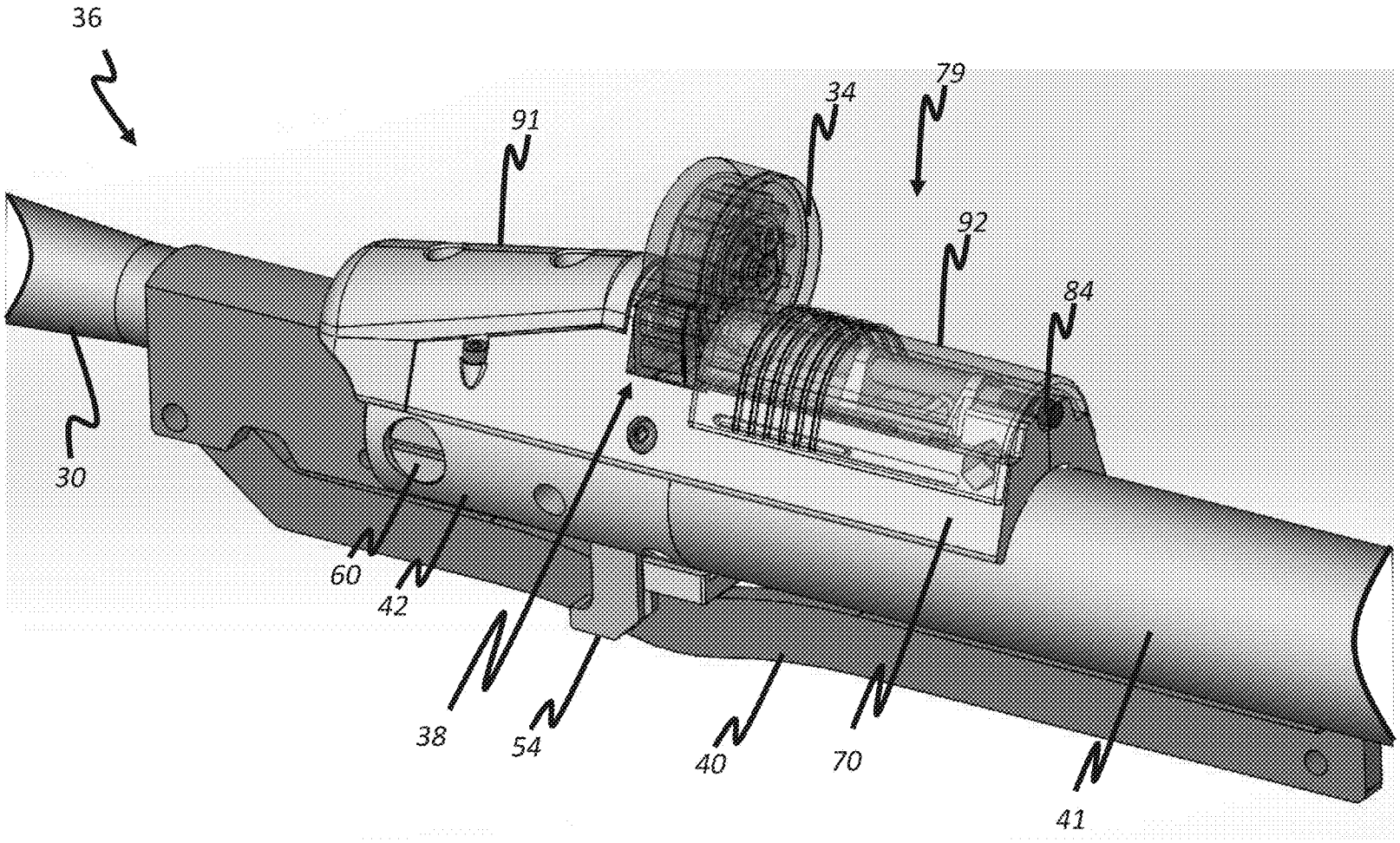
FIG. 2 is a left, top, back view of an assembled loading system of the embodiment of FIG. 1.

FIG. 2 is a left, top, back view of an assembled loading system 36 of the embodiment of FIG. 1 with barrel 30 and tube 41 partially cut away and the forestock of FIG. 1 removed. As is shown in FIG. 2 loading system 36 includes, in part, a magazine holder 38, a tube fork 42, a shuttle 54, a shuttle drive system 55, a loading mechanism 79, and a bolt latch slider 80. In this embodiment loading mechanism 79 can be positioned in association with tube 40 or tube fork 42 by way of a left housing part 70 and a right housing part 76 with an optional front cover 91 and back cover 93 which can be positioned over portions of left housing part 70 and right housing part 76 to protect against incidental contact, contamination and exposure to the elements. Either of front cover 91 or back cover 93 may be made from transparent or translucent materials as illustrated on back cover 93 in FIG. 2.

Figure 3:
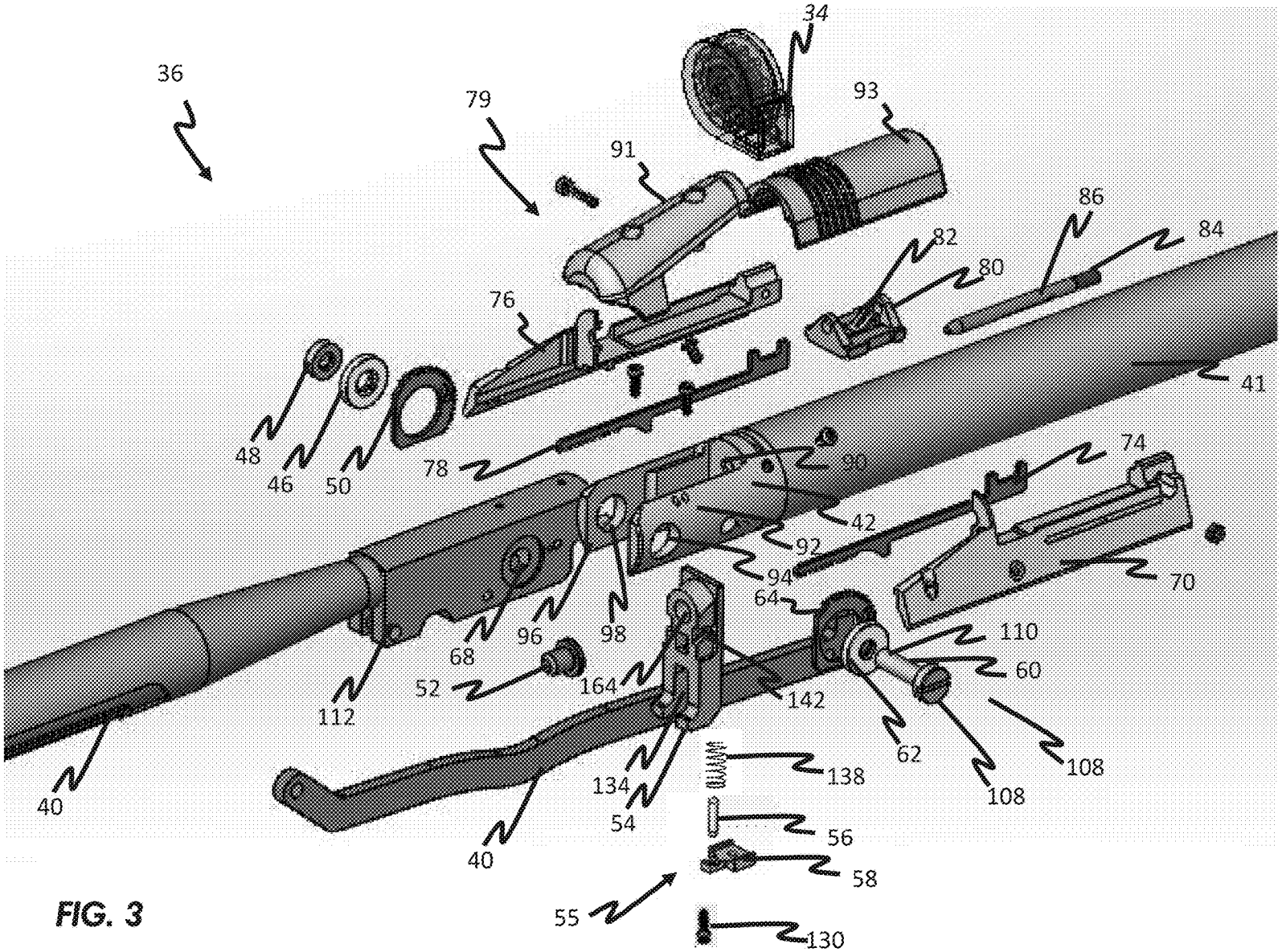
FIG. 3 is a left, top, back exploded view of the loading system of FIG. 1.

FIG. 3 is a left, top, back exploded view of loading system 36 of FIG. 2. As can be seen in FIG. 3, fork tube 42 has a first fork 92 with a first pivot bolt passageway 94 sized to receive pivot bolt 60 and a second fork 96 having a second pivot bolt passageway 98 that is likewise sized to receive pivot bolt 60. Barrel 30 is assembled to tube fork 42 by aligning pivot mount 68 with first pivot bolt passageway 94 and second pivot bolt passageway 98 to provide a path through which pivot bolt 60 may be inserted. In this embodiment pivot bolt 60 has a screw cap 106 at a first end 108 and a second end 110 to which a pivot nut 48 can be joined.

During assembly of barrel 30 to tube fork 42, a left spacer 62 and left spur gear 64 are positioned between first end 108 and second end 110 of pivot bolt 60 and second end of pivot bolt 60 is then passed through first pivot bolt passageway 94, pivot mount 96 and second pivot bolt passageway 98. Right spur gear 50 and spacer 46 are then positioned on pivot bolt 60 between second pivot bolt passageway 98 and second end 110. Pivot nut 48 is then joined to second end 110 to provide a predetermined distance between pivot nut 48 and screw cap 110 or to provide a predetermined clamping force between pivot nut 48 and screw cap 110. This arrangement allows barrel 30 and tube fork 42 to pivot relative to each other between a firing position as shown in FIGS. 1-4 and a cocking position shown in FIGS. 5-7.

A cocking lever 40 is joined to barrel 30 between at a first pivot point 112 and an energy storage device such as a spring or gas piston (not shown) such that as barrel 30 and fork tube 42 are moved from the firing position to the cocking position and back energy is stored in the energy storage device. When trigger system 20 is activated, this energy is released to drive a piston (not shown) toward an inner face 114 of tube fork 42 so as to force compressed air into to a tube fork port 90 that provides a path through tube fork 42 from inner face 114 to outer face 116.

As is also shown in FIG. 3, shuttle drive system 55 includes a spring cap 58 that is mechanically associated with tube fork 42 for example by way a threaded fastener 132. Spring cap 58 positions a center pin 56 and shuttle 54 has a center cavity 134 designed to permit sliding motion of shuttle 54 relative to center pin 56 and any structures assembled about center pin 56 such as for example resilient member 138. Resilient member 138 in turn is positioned about center pin 56 between shuttle 54 and spring cap 58 to bias shuttle 54 away from spring cap 58. Shuttle 54 has a channel 164 that is sized to receive a breech bushing 52 and a shoulder portion 142 as will be discussed in detail below.

As will also be discussed in greater detail below left housing part 70 can be joined to at least one of left side of tube 41 and tube fork 42 to position a left gear rack 74 for sliding motion relative to left housing part 70. Similarly right housing part 76 can be joined to at least one of left side of tube 41 and tube fork 42 to position a right gear rack 78 for sliding motion relative to left housing part 70. As will be discussed in greater detail below left gear rack 74 is also positioned to engage left spur gear 64 while right gear rack 78 is positioned to engage right spur gear 50 so that left gear rack 74 and right gear rack 78 slide in response to rotation of barrel 30 to advance or retract a bolt latch slider 80 that having a pressure release mounting 82 that carries a bolt 86 having an end portion 84. Left housing part 70 and right housing part 76 also combine to form magazine holder 38 for positioning magazine 34 relative to bolt 86.

Figure 4:
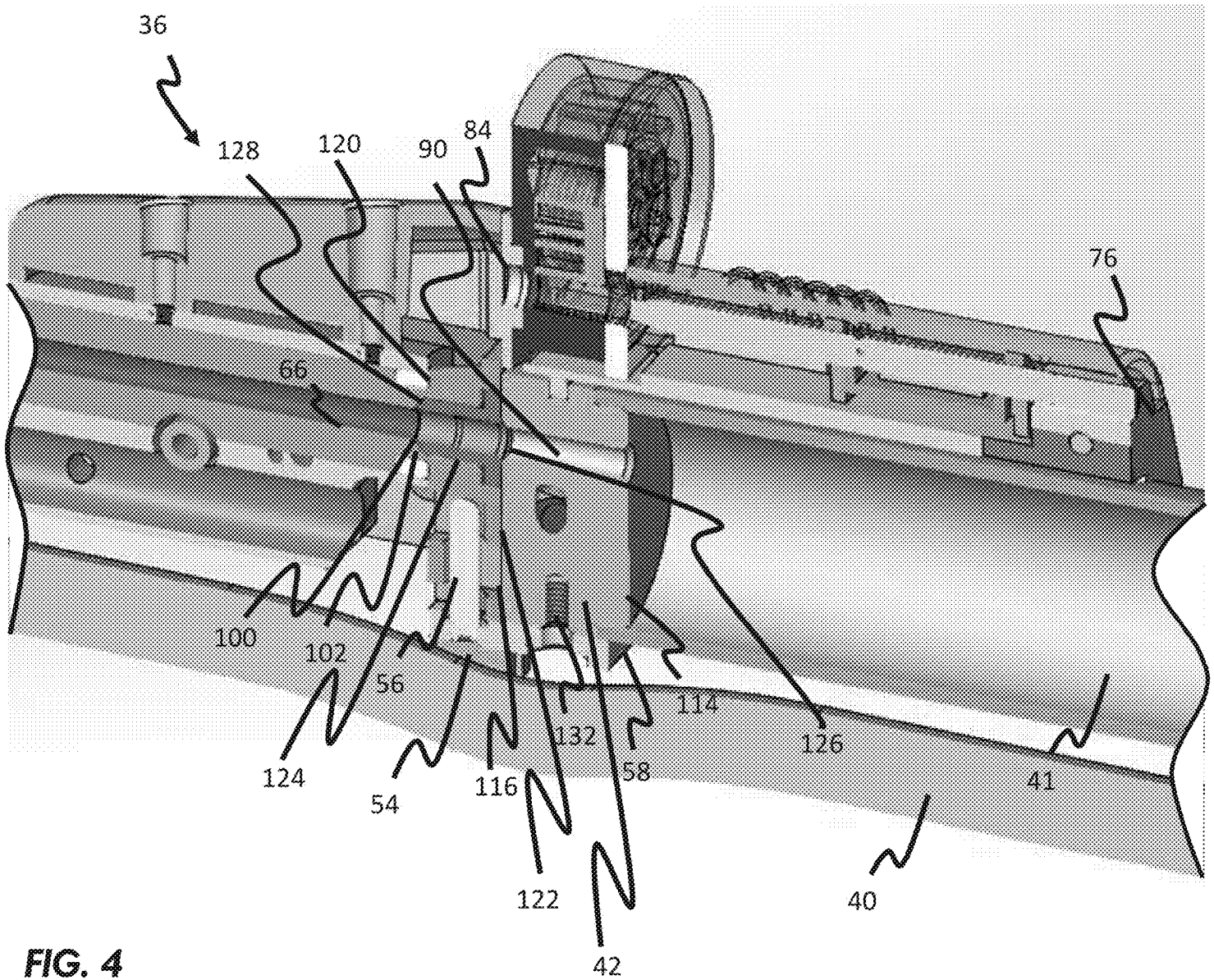
FIG. 4 is a back top left perspective view of a cross-section of the loading system of FIG. 1.

FIG. 4 is a back top left perspective view of a cross section of loading system 36. As is shown in FIG. 4, barrel 30 has a load longitudinal passageway 66 generally extending along a length of barrel 30 beginning at a barrel opening 100 in an interior barrel face 102 of barrel 30. Longitudinal passageway 66 is sized to receive projectiles of predetermined length and width and may be of a smooth bore type or may have rifling along some or all of a length of barrel 30. Barrel 30 also has a pivot mount 68 arranged in this embodiment along an axis that is generally orthogonal to the longitudinal axis and sized so that a pivot bolt 60 can pass therethrough. Barrel 30 is shaped and sized so that a portion of barrel 30 proximate to back face 102 can be positioned between a first fork 92 and a second fork 96 of tube fork 42.

Shuttle 54 is positioned between interior barrel face 102 and an outer face 116 of tube fork 42. Shuttle 54 has a front face 120 confronting interior barrel face 102 and a back face 122 confronting outer face 116 of tube fork 42. Shuttle 54 has a passageway 124 between front face 122 and back shuttle face 124. Shuttle drive system 55 is connected to barrel 30 and to tube fork 42 or some other component of airgun 10 that generally remains stationary relative to tube fork 42 when barrel 30 is moved between the cocked position and the firing position. When barrel 30 is in the firing position as is illustrated in FIGS. 1-4, shuttle drive system 55 positions shuttle 54 such that a back end 126 of passageway 124 is grossly aligned with an output 126 of fork tube port 90 and such that a front end 128 of passageway 124 is grossly aligned with opening 100 of longitudinal passageway 66.

Figure 5:
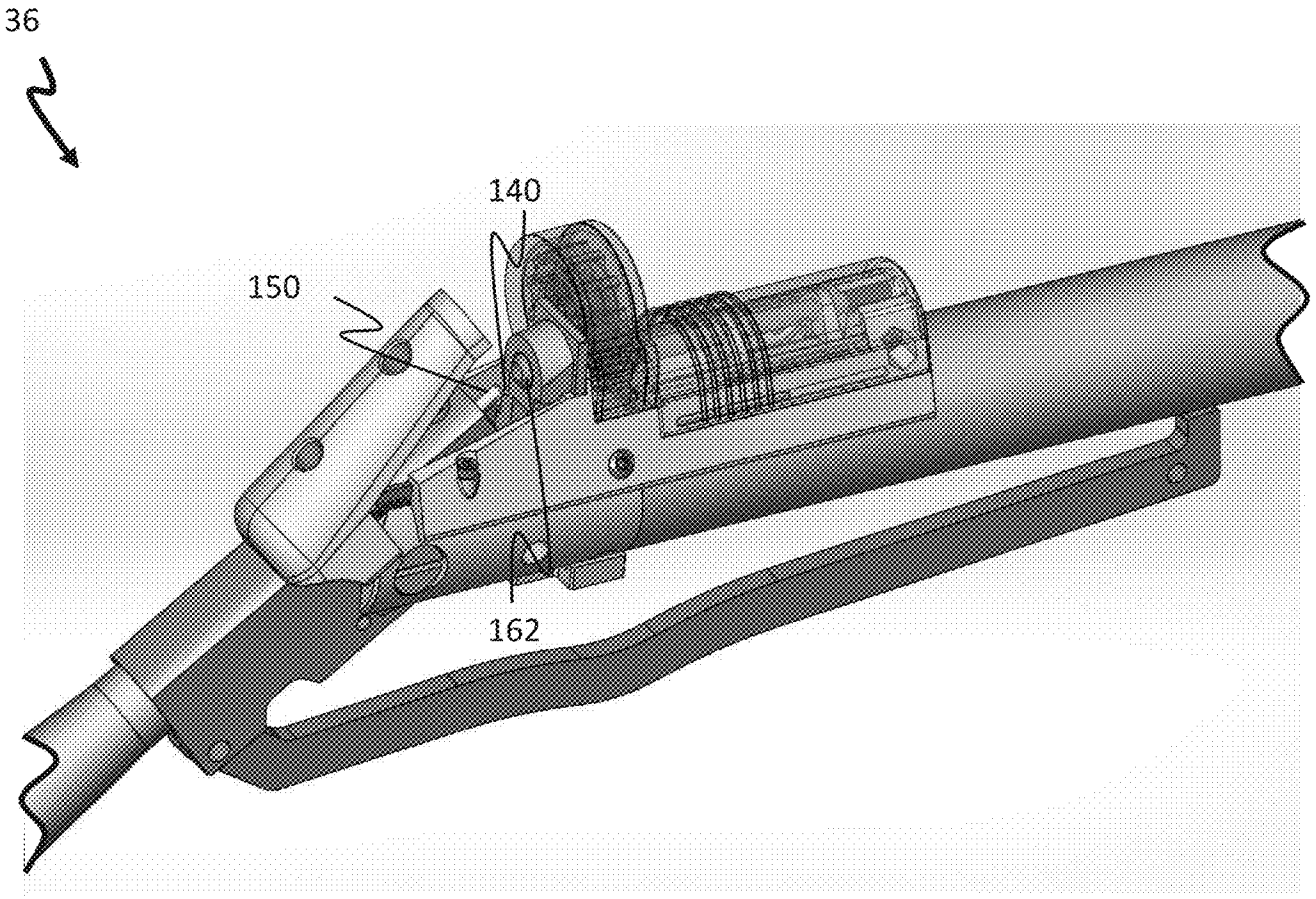
FIG. 5 is front, right, top perspective view of a loading system 36 of the embodiment of FIG. 1 in a first cocking position.

FIGS. 5-9 illustrate the loading system 36 of the embodiment of FIG. 1 in operation. Specifically, FIG. 5 is front, right, top perspective view of a loading system 36 of the embodiment of FIG. 1 in a first cocking position. As is shown in FIG. 5, as barrel 30 is rotated relative to tube 41 during cocking, constraints on the movement of shuttle 54 are released and shuttle 54 is repositioned by action of resilient member 138 along center alignment pin 56 to a position where a projectile can be received in shuttle 54 from loading mechanism 79. After loading shuttle 54 is returned to the firing position and positioned so that pressurized air from port 90 can thrust such a projectile loaded in shuttle 54 toward longitudinal passageway in barrel 30.

The use of shuttle 54 for loading requires that effective seals be established between front face of tube fork 42 and back end 126 of shuttle passageway 124 as well as between front shuttle face 122 and back barrel face 102. Further this system requires precise alignment of tube fork port 90 with the back end of shuttle passageway 126 to prevent turbulent air flows that might consume a portion of the energy in the compressed air supplied from tube fork port 90 during firing. Still further such a system requires that front end of shuttle passageway be precisely aligned with opening 100 of longitudinal passageway 66 of barrel 30. Misalignment at this point can cause turbulent air flow and energy loss as well. However such misalignment also presents the risk that a pellet or other projectile with be partially thrust against back face 102 of barrel 30 which can cause damage to the projectile and inaccurate fire or can cause a pellet or other projectile to be jammed at the interface between barrel face 102 and shuttle 54. Similarly, misalignment of shuttle passageway 100 with loading opening 136 can result in damage to a pellet or jamming incidents. Jamming at between the passageways 100 and loading opening 136 can also occur in the even that a user mistakenly loads more than one projectile into shuttle passageway 126.

It will be appreciated that such misalignment can happen in various ways, along a vertical axis, along a horizontal axis, or both as may occur in the event that shuttle 54 is allowed to slide vertically at a cant and that given the requirements for alignment, thermal and other environmental factors can also impact alignment.

Such concerns place a significant burden on the design of such a system in that a conventional manner of addressing such requirements is to impose exacting constraints on the design of such systems and the materials used such a system. However, such approaches add cost, weight, and complexity which may not be useful in field environments. Alternatively, user adjustment controls can be provided however the need for constant adjustments this creates usability problems.

In the embodiment of loading system 36 shown here, shuttle 54 is biased by a resilient member 134 that, in this embodiment, is positioned about pin 56 and that provides a centered thrust urging shuttle 54 away from the firing position toward the loading position. This helps to ensure alignment of breech bushing channel 164 when loading a projectile from projectile holder 78 as compared to the use of different biasing members on opposite sides of a central support.

Figure 6:
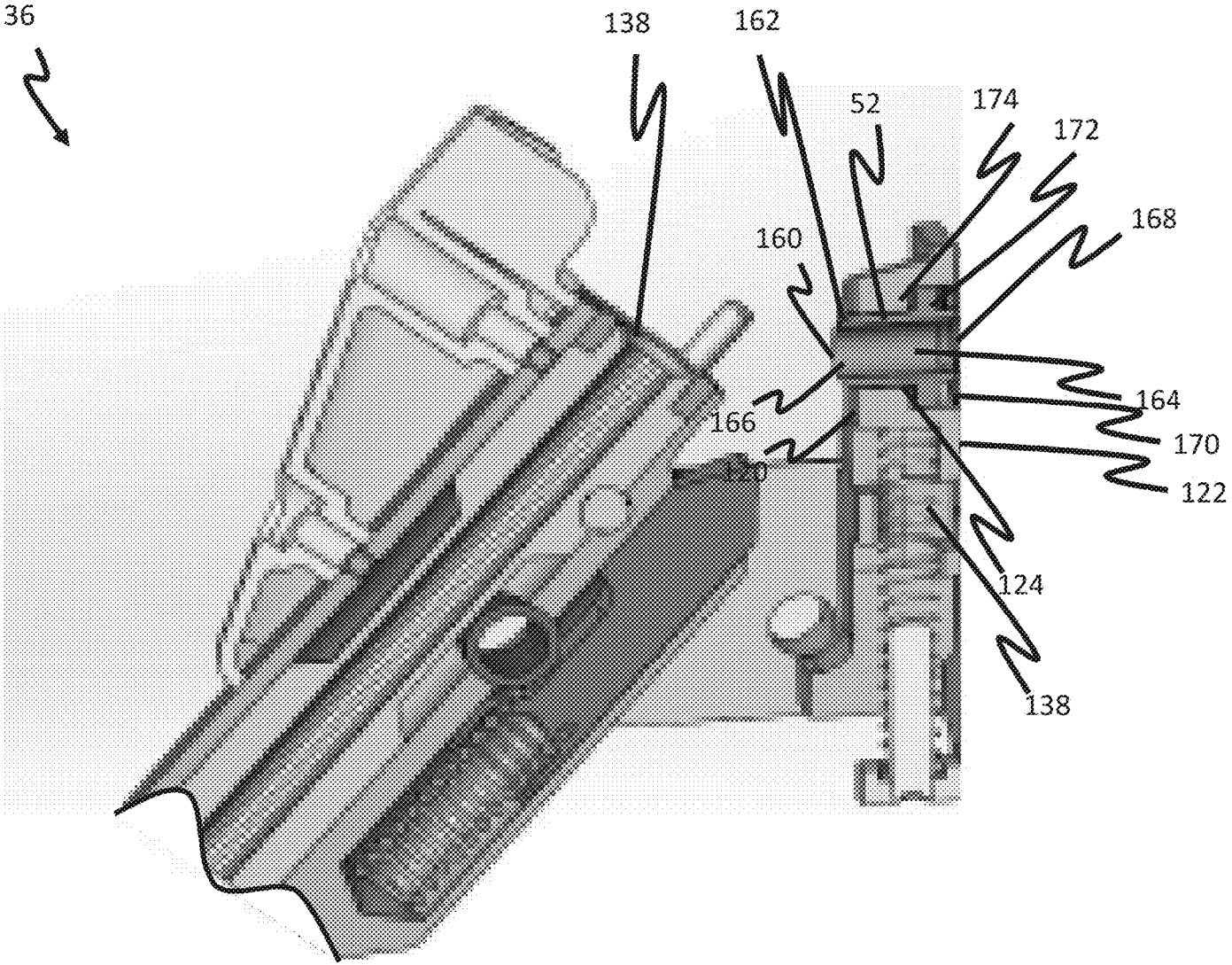
FIG. 6 shows a cross-section of a barrel and shuttle in a further cocking position.
Figure 7:
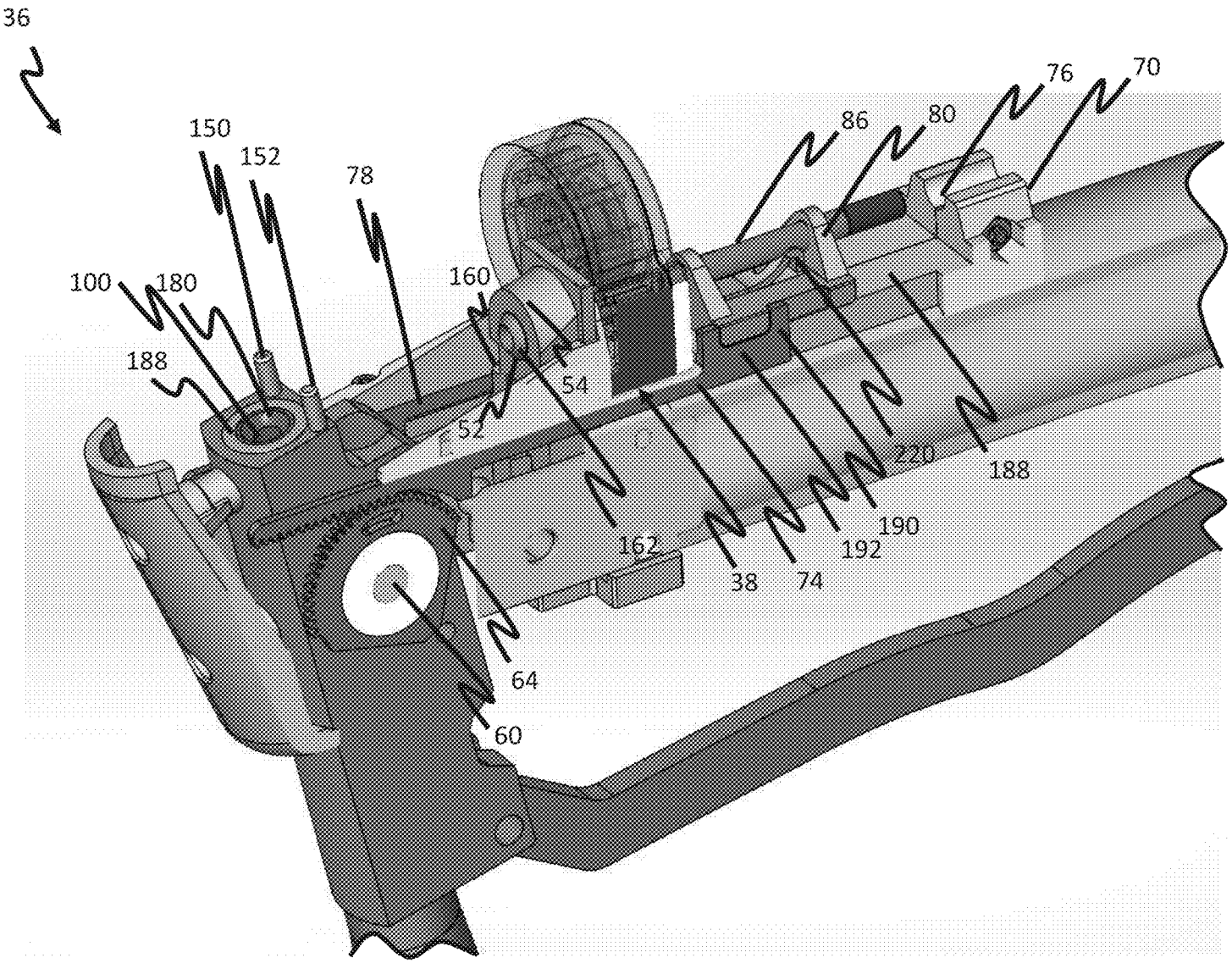
FIG. 7 is a top, left, front perspective view of the loading system in the further loading position of FIG. 6.

It will be appreciated that it is also valuable to ensure that shuttle 54 is returned to the firing position in a manner that helps to ensure alignment between channel 164, longitudinal passageway 66 of barrel 30 and port 90 of tube fork 42. FIG. 6 shows a cross section view and FIG. 7 shows a top, left front view of aspects of loading system 36 that can be used to accomplish this result after barrel 30 has been rotated to enable loading of a projectile (not shown). In this embodiment, to help ensure that shuttle 54 is returned to the firing position with channel 164 in the desired alignment, shuttle 54 provides bilateral shoulders 140 and 142 that are arranged to interact with positioning beams 150 and 152 that project from back face 102 of barrel 30 such that as positioning beams 150 and 152 rotate with barrel 30 about pivot bolt 60 through a radius that brings positioning beams 150 and 152 into contact with shoulders 140 and 142 as barrel 30 is rotated from the cocking position to the firing position. The force provided against shoulders 140 and 142 positively drives shuttle 54 against the bias of a resilient member 138 to provide bilateral vertical position control over shuttle 54. This further constrains the extent to which canting of shuttle 54 can cause misalignment. Additionally, this provides for vertical positioning of shuttle 54 relative to barrel 30 using reference surfaces that are proximate to barrel 30 and to shuttle passageway 124. This has the effect of limiting the extent to which thermal effects can cause misalignment. It will also be noted that the use, in this embodiment, of positioning beams 150 and 152 with a rounded shape provides tangential contacts with shoulders 140 and 142 such that in the event that foreign materials such as dust, dirt, or grime gets into this system the contact will urge materials away from contact points preserving alignment and positioning.

Even using such an approach, maintaining precise alignment and positioning of a movable shuttle 54 relative to barrel opening 120 and tube fork port 90 remains challenging. In particular, it is challenging to provide such alignment while maintaining a light weight and easy to use air gun. For example, if dissimilar materials are used for barrel 30, tube fork 42 and shuttle 54, differences in the rate of thermal expansion can cause differences in alignment that can be difficult to match. As barrel 30 and tube fork 42 are typically made of metal, this tends to require that shuttle 54 likewise be made of metal. Such a decision increases the cost and weight of the air gun 10.

The embodiments of FIGS. 1-9 offer solutions to such problems. As is shown, for example in FIG. 6, which shows a cross section barrel 30 and shuttle 54 in a further cocking positions, in these embodiments, shuttle passageway 124 has a larger cross sectional area than do opening 100 of barrel 30 or tube fork port 90 and is sized and shaped to receive breech bushing 52 into longitudinal passageway 66 which is likewise sized and shaped to receive breech bushing 52. In the embodiment of FIGS. 1-9, breech bushing 52 has a front end 160 with a shaped surface 162, and a channel 164 extending from a front opening 166 at front end 160 to a back opening 168 at a back 170 of breech bushing 100. Breech bushing 52 has a length between front end 160 and back end 170 that is greater than a length between front shuttle face 120 and back shuttle face 122. Further breech bushing 52 has a lateral extension 172 extending outwardly in a direction that is not parallel to a direction of channel 164 which may for example take the form of a circumferential flange as shown here or which may take other forms.

In this embodiment, breech bushing 52 is not rigidly joined to shuttle passageway 124 but can move within shuttle passageway 124 within any space provided between breech bushing 52 and shuttle passageway 124. In embodiments, shuttle passageway 124 and breech bushing 52 may be designed so that movement of breech bushing 52 is constrained in certain manners. For example, in this embodiment, breech bushing 52 has a lateral extension 172 extending outwardly in a direction that is not parallel to a direction of channel 164 which may for example take the form of a circumferential flange as shown here or which may take other forms and shuttle passageway 124 has a stop 174 positioned therein to interfere with lateral extension 172 to constrain the extent to which breech bushing 52 can move toward front shuttle face 120. This arrangement can be used for example, help retain breech bushing 52 within shuttle passageway 124 during firing or loading. Other arrangements are possible.

Further, in this embodiment, breech bushing 52 has a length between front end 160 and back end 170 that is greater than a length between front shuttle face 120 and back shuttle face 122. This arrangement can be used to help define the extent, if any, to which front end 160 and back end 170 project from front shuttle surface 120 and from back shuttle surface 122.

FIG. 7 is a top, left, front perspective view of loading system 36 in the further loading position of FIG. 6. As can be seen in FIGS. 6 and 7, in this embodiment breech bushing 52 and shuttle 54 are configured so that shaped surface 162 projects from front shuttle face 120. As can also be seen in FIGS. 6 and 7, barrel 30 has an opening 100 with a guide surface 180 that is shaped when barrel 30 is moved to return loading system 36 to the firing position, guide surface 180 interacts with co-designed shaped surface 162 to further center front opening 166 of channel 164 relative to longitudinal passageway 66. This helps to prevent wasted energy and the risk of accuracy loss or jamming issues potentially caused by misalignment. Further, in embodiments where there is good positional alignment between longitudinal passageway 66 and fork tube port 90, alignment of breech bushing channel 164 with longitudinal passageway 66 may help to achieve better alignment of breech bushing channel 164 with fork tube port 90. In this embodiment, the use of circular tapered features for shaped surface 162 and guide surface 180 permits centering alignment of breech bushing 52 and at least opening 100 from any direction of misalignment.

In embodiments, the use of this centering interaction between shaped surface 162 of breech bushing 52 and guide surface may permit shuttle 54 to be made from different materials than breech bushing 52. For example, certain light-weight materials may be useful and function to form a shuttle 54 that can position breech busing 52 within a range of positions where shaped surface 162 and guide surface will interact to secure desirable alignment that could not achieve such precise positioning. Similarly, certain materials may be used in shuttle 54 that might not prove capable of that might wear or change dimensions unacceptably if exposed to high air pressure. These and other benefits of making breech bolt 52 and shuttle 54 using different materials may also be available in embodiments that use different centering/alignment solutions.

As is also shown in the embodiment of FIGS. 1-7 a seal 188 can be provided on back barrel face 102 to help retain air pressure at the interface between longitudinal passageway 66 and channel 164 while a seal (not shown) may be provided on either of fork tube front wall.

In embodiments, breech bushing 52 may have a channel 164 with an outer diameter that is larger than the anticipated caliber of projectile to be loaded in to breech bushing 52. Such a channel 164 can then taper such that the size of channel 164 is about the size of longitudinal passageway 66 at the interface therebetween.

Loading of a pellet or other projectile is accomplished by way of loading mechanism 79 which operates. FIG. 7 shows a left, front, top perspective of a loading mechanism 78 used to perform loading of a pellet or other projectile as barrel 30 and tube fork 42 are rotated relative to each other during the cocking process. As noted with reference to FIG. 3, loading mechanism 79 comprises right spur gear 50 and left spur gear 64, right gear rack 78 and left gear rack 74, left housing part 70, right housing part 76, bolt latch slider 80 and bolt 86.

Right spur gear 50 is positioned on pivot bolt 60 on a left side of barrel 30 for rotation with barrel 30 about pivot bolt 60. Similarly, left spur gear 64 (not shown in FIG. 7) is positioned on pivot bolt 60 on a left side of barrel 30 for rotation with barrel 30.

Left housing part 70 and right housing part 76 are joined together and to tube fork 42 or other components of air gun 10 and provide mountings to which left gear rack 74 and right gear rack 72 can be mounted for slidable longitudinal movement relative thereto. When assembled, left housing part 70 and right housing part 76 further provide a slide path 196 on which bolt latch slider 80 can be moved longitudinally between a forward and a rear position. FIG. 7 illustrates an example of engagement between left spur gear 64 and left gear rack 74. As can be seen from FIG. 7, when loading system 36 is moved to the cocked position shown, left gear rack 74 is drawn forward. Left gear rack 74 in turn has engagement features 190 that engage engagement features 192 of bolt latch slider 80 so that movement of left gear rack 74 causes movement of bolt latch slider 80. Although the interaction between right spur gear 50 and right gear rack 72 is not visible in FIG. 8, it will be understood that bolt latch slider 80 interacts in a complimentary fashion with these components so that generally equivalent forces are applied against bolt latch slider 80 to cause bolt latch slider 80 to move with generally even forces being applied on each side. Single sided arrangements are possible.

As is shown in FIG. 7 left housing part 70 and right housing part 76 also combine to form a magazine mount 38 that holds a magazine 34 relative to bolt 86.

Figure 8:
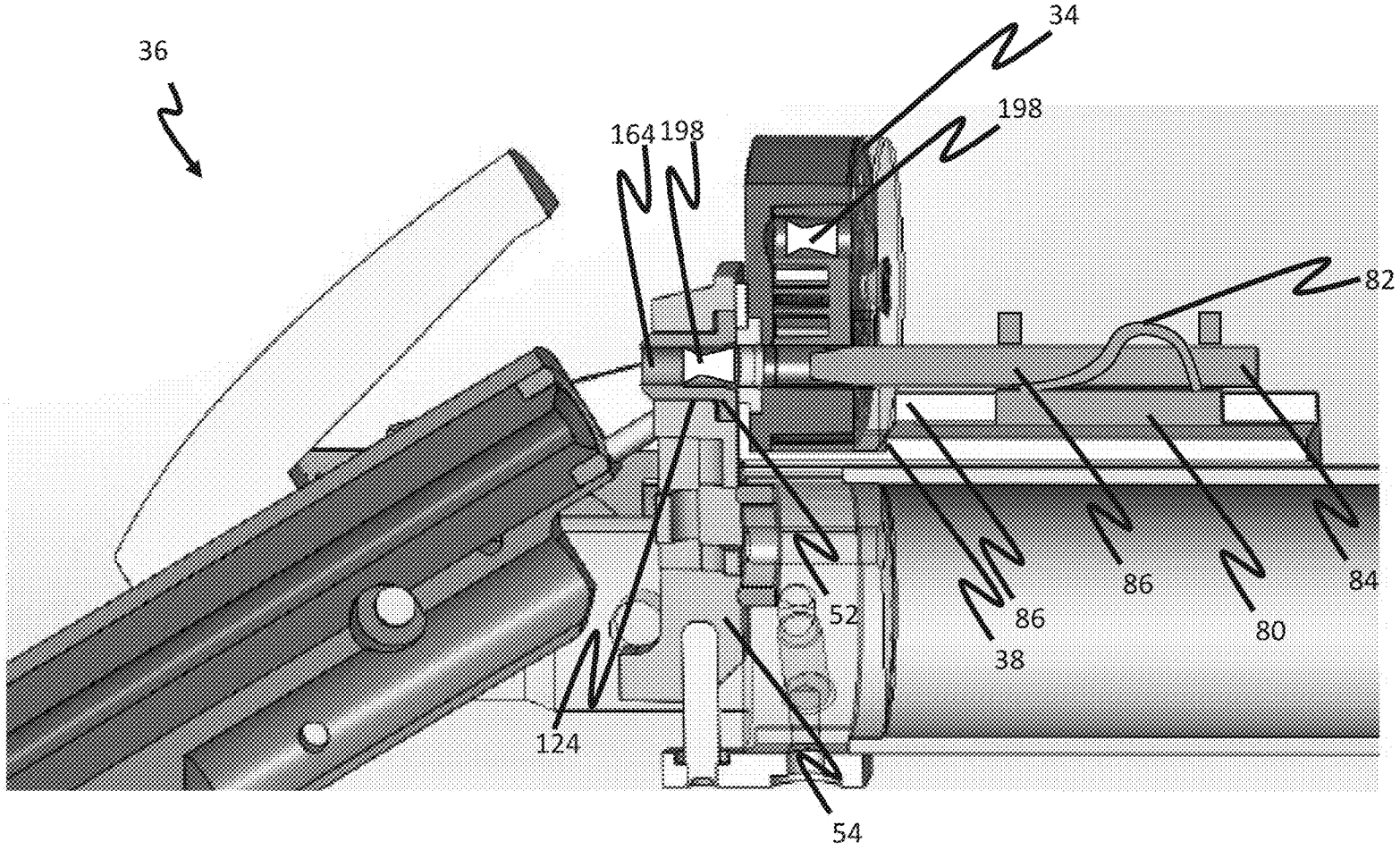
FIG. 8 is a left side cross-section view of a loading system 36 of FIG. 1 after one of a plurality of pellets from magazine has been loaded into breech bushing.

FIG. 8 is a left side cross-section view of a loading system 36 of FIG. 1 after one of a plurality of pellets 198 from magazine 34 has been loaded into breech bushing 52. As is shown in FIG. 8, bolt 86 can be advanced through a pellet storage chamber 200 of magazine 34 to drive a pellet 198 into breech bushing 52 as bolt latch slider 80 is moved from the rearward position to the forward position.

As is shown in FIGS. 7 and 8, bolt 86 is held for movement with bolt latch slider 80 by a resilient member 220. Resilient member 220 holds bolt 86 with sufficient holding force to properly position a projectile but not, for example with a level of force that is, for example, necessary to drive a second projectile into bushing 52 in a manner that creates a jam—such as where a user double cocks system 36. Accordingly, the holding force can be set to begin allowing bolt 86 to move relative to bolt latch slider 80 when a predetermined level of force is reached that is less than required to cause such an event. This release allows displacement of bolt 86 relative to bolt latch slider 80. Where this occurs, bolt latch slider 80 is displaced along a length of bolt 86 to a portion of bolt 86 that is forward of a normal position. Accordingly, when bolt latch slider 80 is returned to a rearward position as bolt latch slider is retracted to a firing position an end 84 of bolt 86 is thrust further rearward than normal. In the embodiment of FIGS. 1-8 a bolt 92 cover optionally can be provided and can be positioned over portions of left housing part 70 and right housing part 76 with an opening at a rearward portion thereof through which end portion 84 of this differently positioned bolt 86 will project providing a visual indication of a loading problem.

This approach can be used to protect airgun 10 from damage in other circumstances where airgun 10 may be damaged by unexpected events such as the pressing of bolt 86 against a portion of the magazine as may occur in the event that magazine 34 has moved relative to magazine holder 38 or when the force applied against bolt 86 begin to reach any predetermined level is less than an amount of force necessary to damage at least one of the sled, the bolt, the shuttle and the transmission.

It will be appreciated from the foregoing that the embodiments of airgun 10 described above can allow for rapid automatic reloading of a break-type airgun 10. It will also be appreciated that the action described in the embodiments above has a shuttle with a sliding type motion that works well when a pellet or other projectile is positioned between front shuttle face 120 and back shuttle face 122 before firing.

However, there is a possibility that certain factors may cause a pellet to be positioned partially between front shuttle face 120 and back shuttle face 122 and partially outside of the front shuttle face and back shuttle face 122 during retraction of bolt 86. For example, in certain circumstances, a pellet may conformably adhere to bolt 86 or otherwise be urged to follow bolt 86 as bolt 86 is withdrawn from shuttle 54.

Figure 9:
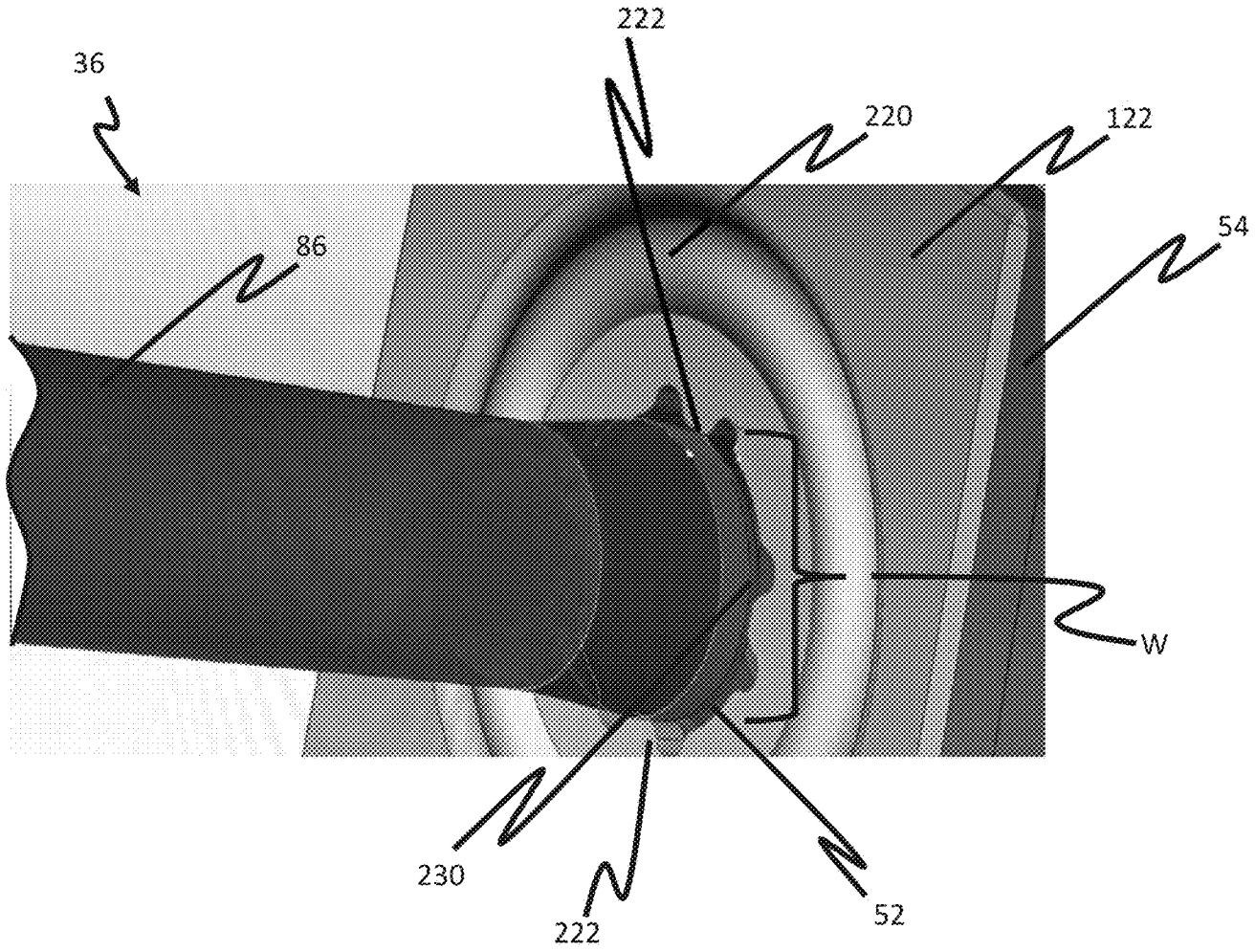
FIG. 9 shows a partial right, back, top perspective view of one embodiment of a bolt and a resilient barrier located proximate a back shuttle face with the bolt positioned to begin passing through an opening in resilient barrier.
Figure 10:
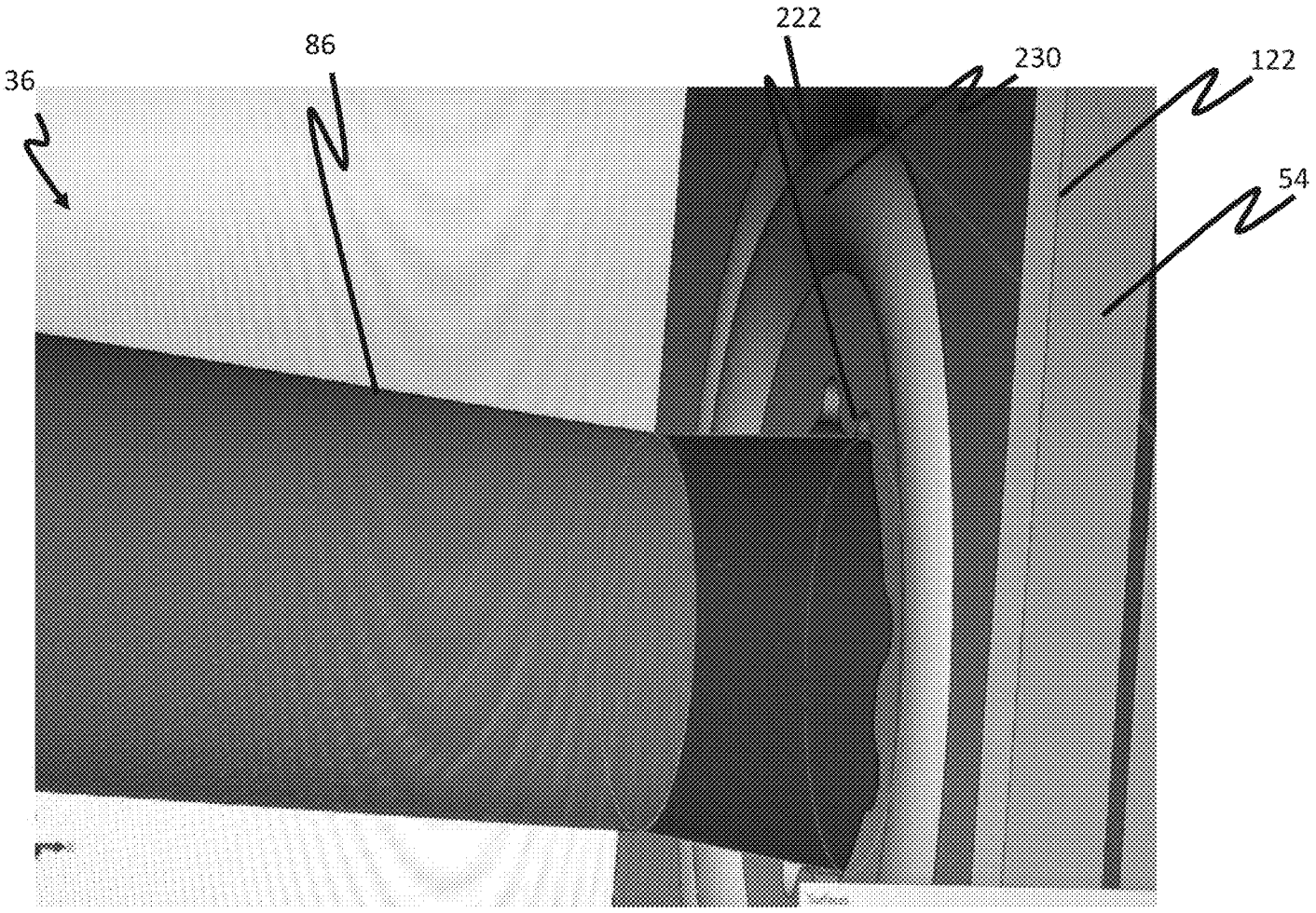
FIG. 10 shows a partial right, back, top perspective view of a bolt and resilient barrier provided in the form of an O-ring that is located proximate a back shuttle face with bolt positioned partially passing through an opening in the resilient barrier.

FIG. 9 shows a partial right, back, top perspective view of a bolt 86 and resilient barrier 220 provided in the form of an O-ring that is located proximate a back shuttle face 122 with bolt 86 positioned to begin passing through an opening in resilient barrier 220. FIG. 10 shows a partial right, back, top perspective view of a bolt 86 and resilient barrier 220 provided in the form of an O-ring that is located proximate a back shuttle face 122 with bolt 86 positioned to partially passing through an opening in resilient barrier 220. FIG. 10 shows a partial right, back, top perspective view of a resilient barrier 220 provided in the form of an O-ring that is located proximate a back shuttle face 122. As is shown in FIGS. 9 and 10, resilient barrier 220 is positioned along the path of travel of bolt 86 as bolt 86 pushes a pellet (not shown in FIG. 9 from a magazine (not shown in FIG. 9) into breech bushing 52 of shuttle 54. In this embodiment, a resilient barrier 220 has at least one opening flap portion 222 that is configured with a resilient bias to remain in an unloaded position that interferes with the path of travel of a pellet as bolt 86 advances such a pellet into breech bushing 52. The bias is configured to allow opening flap portion 222 yield to the force applied by bolt 86 and by pellet 198 as pellet 198 and bolt 86 pass into breech bushing 52 of shuttle 54. As is shown in FIG. 10, as bolt 86 passes resilient barrier 220 opening flap portion 222 is resiliently biased to move back to or toward an initial position.

Figure 11:
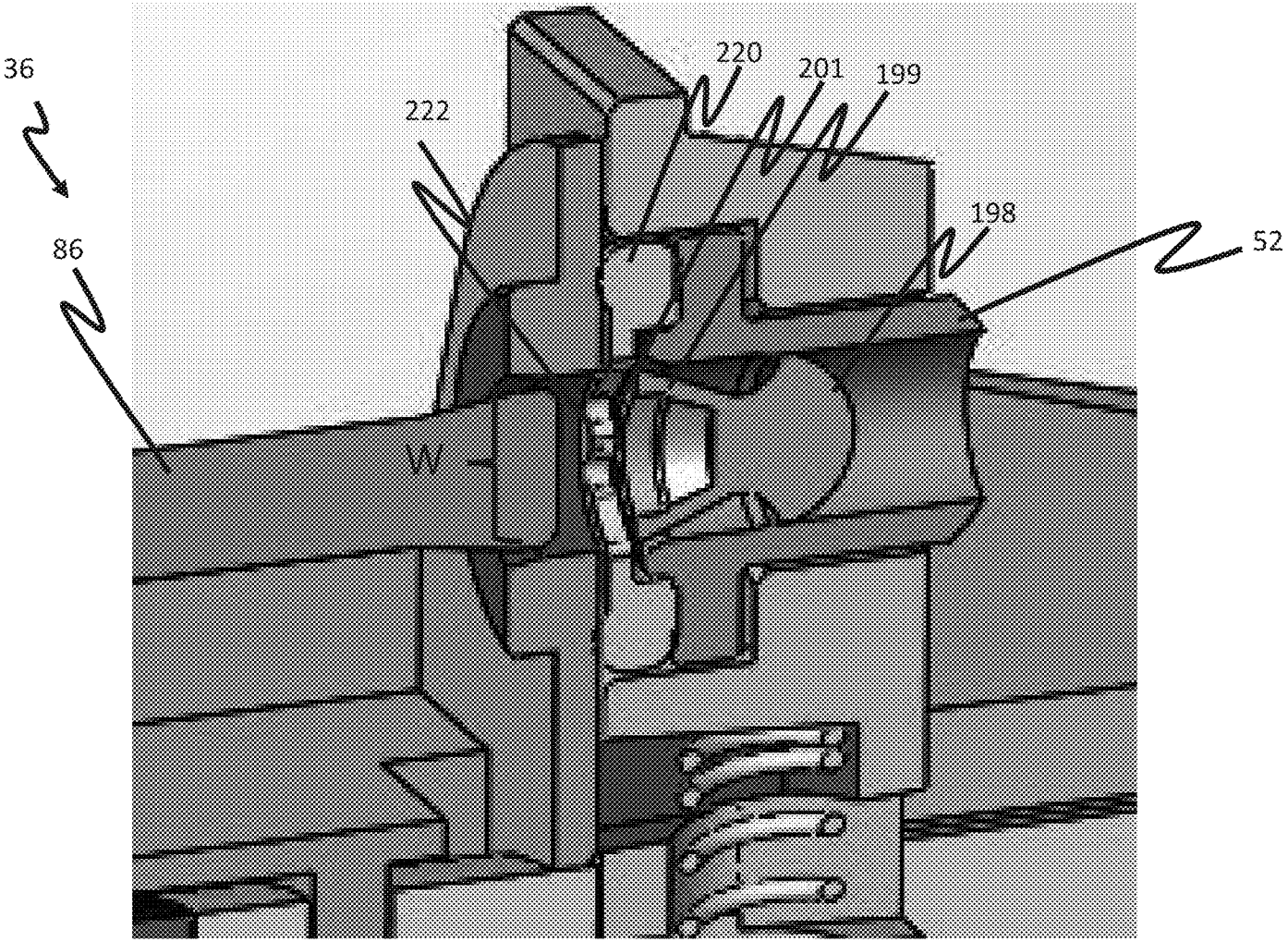
FIG. 11 shows a left, top, front, cut away and sectioned view of the embodiment of bolt 86 and O-ring 200 of FIGS. 10 and 11.

FIG. 11 shows a left, top, front, cut away and sectioned view of the embodiment of bolt 86 and O-ring 200 of FIGS. 10 and 11. As bolt 86 passes out of breech bushing 52 and shuttle 54, bolt 86 also comes into contact with opening flap portion 222 which applies resistance against movement of bolt 86. However, bolt 86 is moved with sufficient force to overcome any resistance to such movement applied by opening flap portion 222 against bolt 86. However, the bias applied by opening flap portion 222 is defined so that opening flap portion applies sufficient force against a skirt 199 or other portion of pellet 198 to overcome any adhesion between bolt 86 and pellet 198 and to hold pellet 198 within shuttle 54. In the embodiment illustrated opening flap portion 222 is formed from a common resilient substrate with opening flap portion 222 with the resilient bias of the resilient substrate providing the biasing force. However in other embodiments, resilient barrier 220 may be mechanically associated with opening flap portion 222 in other ways including but not limited to being assembled thereto and similarly such a biasing force can be applied by another source of resilient bias including but not limited to a spring or other biasing member.

In the embodiment shown in FIGS. 9-11, bolt 86 has a tip portion 230 with a width W defined to engage a pellet 198 generally along a back perimeter 201 of a skirt 199 of pellet 198. This optional feature allows pellet 198 to be advanced without positioning pellet 198 based upon a point of contact between the interior of skirt 199 and bolt 86 which can make the ultimate position of a pellet dependent upon the geometries of skirt 199 and the bolt 86.

In certain cases engaging pellet along the back perimeter 201 also has the effect of limiting the extent of the contact area between bolt 86 and skirt 199 which can limit adhesion or any other forces holding pellet 198 to bolt 86. Where forces holding pellet 198 and bolt 86 are lessened opening flap portion 222 can effectively separate pellet 198 from bolt 86 without requiring the application of significant force. This lessens the extent of force required to advance and retract bolt 86 and reduces the effects of wear on the operation of resilient barrier 220 and opening flap portion 222. Additionally, as noted above pressing on a back surface of skirt 198 rather than on an interior portion of skirt 198 allows more precise control over the point of engagement between skirt 199 and bolt 86. In this embodiment, a plurality of such opening flap portions 222 are used and these are arranged to create an inner diameter that is smaller than an outer diameter of back perimeter 201 of pellet 198.

Figure 12:
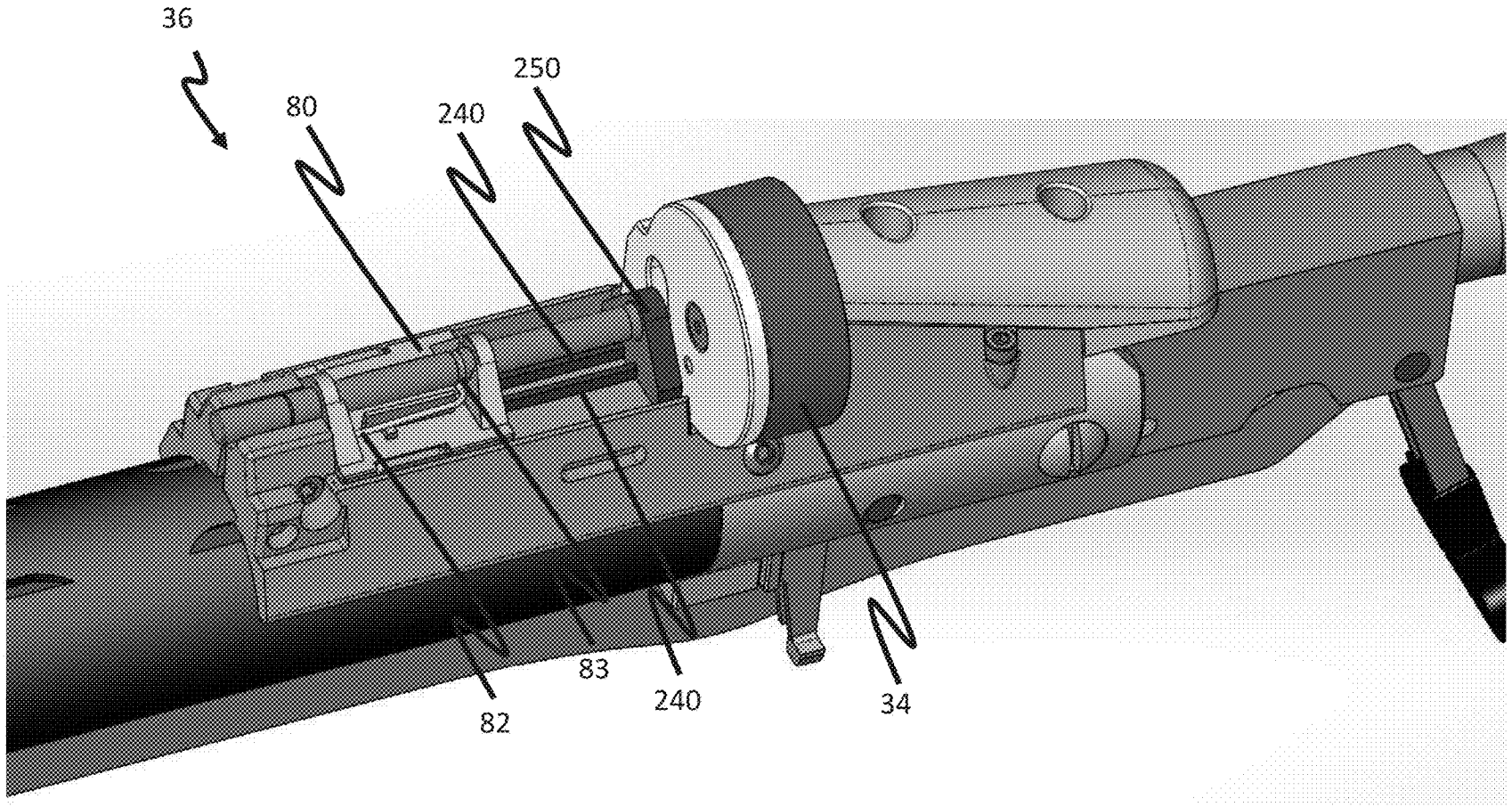
FIG. 12 is a top, back, right side view of another embodiment of a loading system with a bolt latch slider and bolt positioned before loading of a projectile begins.
Figure 13:
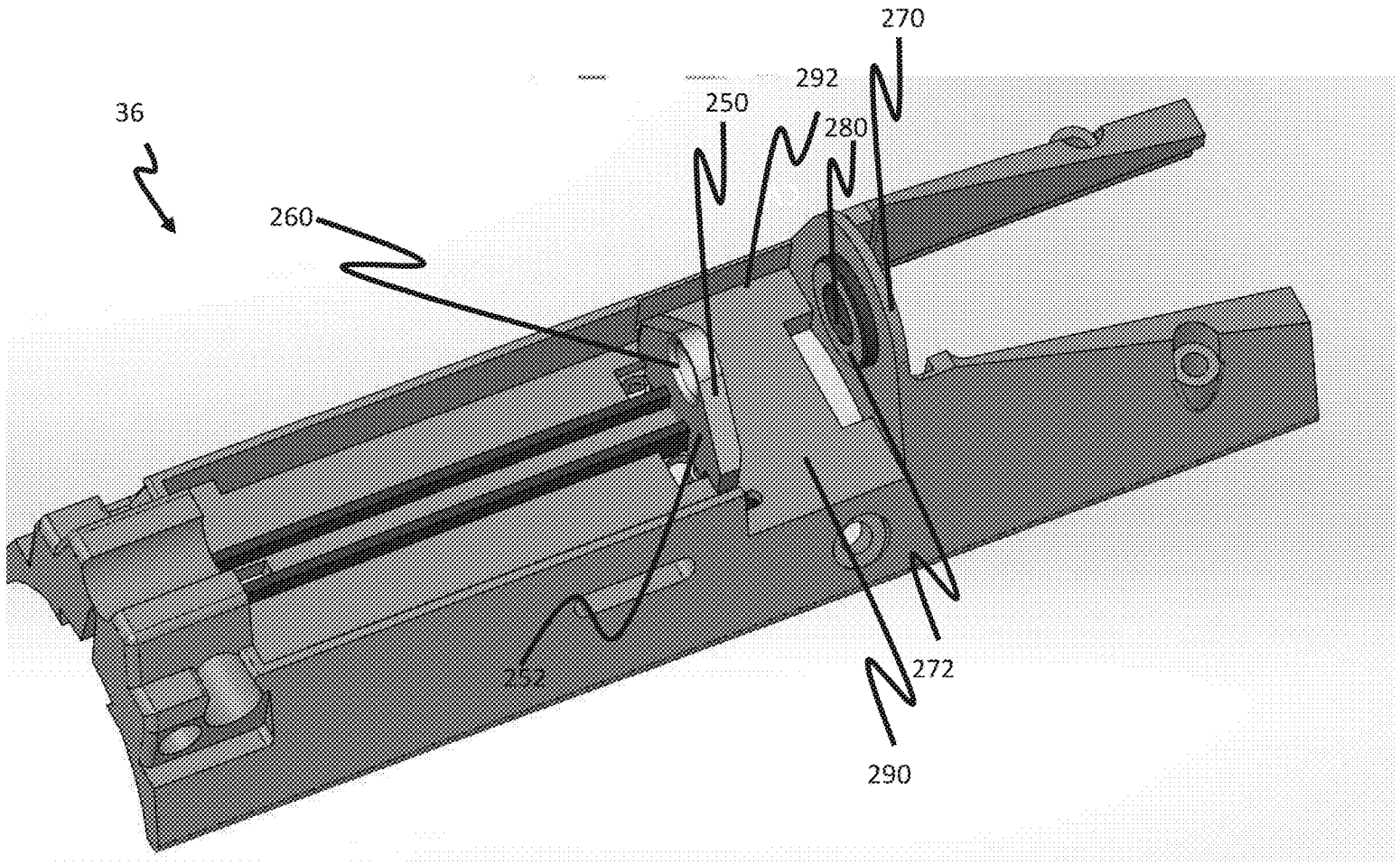
FIG. 13 is a top, right, back perspective view of the embodiment of FIG. 12 with the bolt latch slider and bolt removed.
Figure 14:
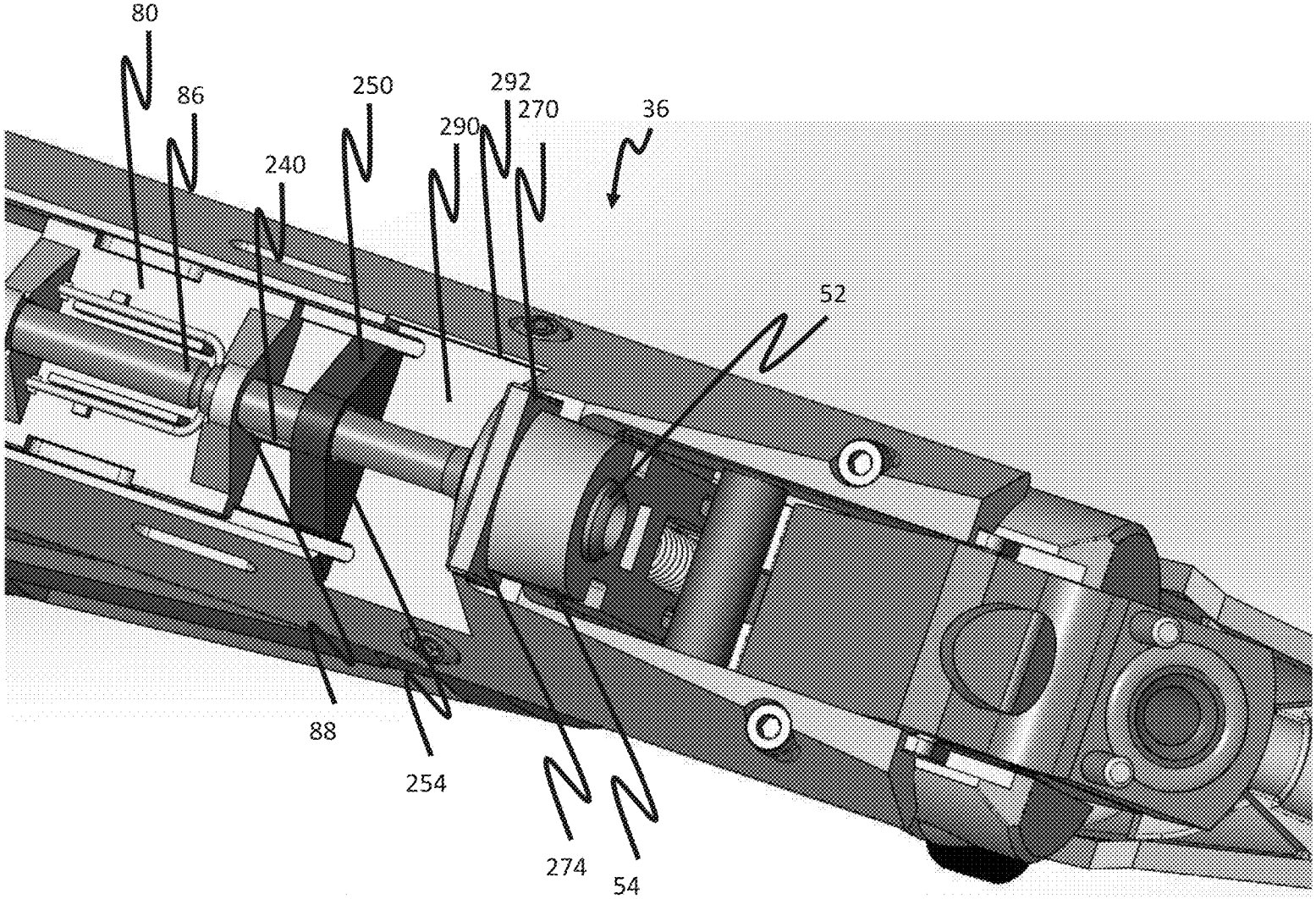
FIG. 14 is a top, front, perspective view of the embodiment of FIG. 12 with the bolt latch slider and bolt positioned just before loading of a projectile begins.

FIG. 12 shows a top, back, right side view of another embodiment of a loading system 36 with a bolt latch slider 80 and bolt 86 positioned before loading of a projectile begins. FIG. 13 is a top, back, right side perspective view of the embodiment of FIG. 12 with a bolt and bolt latch slider 80 removed. FIG. 14 is a top, front, perspective view of the embodiment of FIGS. 12 and 13 with bolt latch slider 80 and bolt 86 positioned just before loading of a projectile such as a pellet begins. As is shown in FIGS. 12 and 14, a bolt latch slider 80 is used having at least one rail slide mount 88 to mount about at least one slide rail 240 to help bolt latch slider 80 moves bolt 86 along an axis that is closely aligned with a preferred axis used to advance a pellet from magazine 34 into breech bushing 52 such as by limiting an extent of a yaw of bolt latch slider 80 or by helping to limit an extent of any lateral deviation of bolt latch slider 80 relative to an extent to which bolt latch slider 80 moves bolt latch 86 along an axis that is parallel to but laterally displaced from the preferred axis.

As is also shown in the embodiment of FIGS. 12, 13, and 14, a first bolt guide 250 is provided between bolt latch slider 80 and magazine 34. First bolt guide 250 has a rear surface 252 and a front surface 254 and a bolt guide passage 260 that is aligned with bolt latch slider 80 so that movement of bolt latch slider 80 from the rear to the front moves bolt 86 through first bolt guide passage 260. As is shown in FIGS. 13, 14 and 15 a second bolt guide passage 270 is positioned opposite and spaced apart from first bolt guide 250 and has a rear surface 252 and a front surface 274 with a second bolt guide passage 280. Second bolt guide passage 280 is aligned with bolt latch slider 80 so that movement of bolt latch slider 80 from a retracted position toward a loading position moves bolt 86 through first bolt guide passage 260 and second bolt guide passage 280.

Also shown in FIGS. 13 and 14 is one embodiment of a magazine holder 38 formed between a surface 254 of first bolt guide 250 and rear surface 272 of second bolt guide passage 270 which are separated by a distance D that is sized to receive and hold magazine 34 as shown in FIG. 12. Additionally, one or more mounting surfaces such as surfaces 272, 290, 292 shown in FIG. 1 are provided to engage with mating surfaces of magazine 34 so as to position a magazine opening in alignment with first bolt guide passage 260 and second bolt guide passage 270.

During loading bolt latch slider 80 is moved from a rear most position toward a forward position. As this occurs, bolt 86 is moved by bolt latch slider 80 first toward first bolt guide passage 260. As bolt 86 passes into first bolt guide passage 260, first bolt guide passage guides bolt 86 into an alignment with the opening of magazine 34 at a rear face of magazine 34 and toward a first pellet positioned by magazine 34 in the opening. Further advancement of bolt latch slider 80 drives bolt 86 into contact with a pellet located in magazine 34 and begins urging the pellet to advance toward a second opening in magazine 34 at a rear surface of magazine 34.

A second opening of magazine 34 is provided at a front surface of magazine 34 and is aligned with second bolt guide passage 280 and serves to align a pellet and bolt passing through with an opening of breech bushing 52 in shuttle 54 such that as bolt latch slider 80 reaches a forward most position the pellet is positioned within a preferred range of positions within breech bushing 52. In embodiments rear surface 272 can be shaped to interact with mating shapes on magazine 34 to help ensure such alignment.

The use of first bolt guide 250 and second bolt guide passage 270 help to ensure proper alignment of bolt 86 at critical junctures in the movement of bolt 86 into magazine 34 and into shuttle 54 respectively. In embodiments either or both of first bolt guide passage 260 and second bolt guide passage 280 can include surfaces that are tapered or otherwise shaped to deflect or otherwise guide bolt 86 into a preferred range of positions for engaging pellet or inserting a pellet into breech bushing 52 of shuttle 54 respectively.

Further, by providing proper alignment at these critical junctures, the risk of jamming or misalignment of a pellet relative to breech bushing during loading of a pellet can be significantly reduced.

Nevertheless it is possible that under unusual circumstances, a jam may occur as shuttle 54 is urged to move from the loading position to a position aligned with barrel 30 during a reloading process. To allow a user to address such a situation in the field, first bolt guide 250 can be separably mounted to loading system 36 such as at magazine positioning surface 290. In the event that a jam arises when bolt 86 is partially located within magazine 34, the separable mounting of first bolt guide 250 allows the removal of both magazine 34 and bolt 86 to allow greater ease of access to shuttle 54 to clear the jam.

In the embodiments, the sliding motion of bolt latch slider 80 can be driven by the relative pivotal motion of barrel and tube fork 42 using mechanisms other than meshing gears. For example, and without limitation, a cam and pin system can be used.

Pressure release mounting 82 can take a variety of forms and can interact with bolt latch slider 80 in a variety of ways to hold bolt 86 until forces acting on bolt 86 reach a predetermined level of force. For example, FIGS. 7 and 8 show a pressure release mounting 82 that is formed from a common substrate with bolt latch slider 80 and uses a combination of resiliently applied force and friction to hold bolt 86 until a predetermined pressure is reached. In the embodiment of FIGS. 12-14 pressure release mounting 82 is shown in the form of a structure such as a resilient shaped material that is joined to bolt latch slider 86 and that includes a portion that is pressed into a co-designed slip ring 83 on bolt 86 with the interaction between the pressure release mounting 82 and the co-designed slip ring 83 being calculated to require the application of a predetermined amount of force against bolt 86 before slip ring 83 will slip from engagement with pressure release mounting 82.

The invention has been described in detail with particular reference to certain preferred embodiments thereof, but it will be understood that variations and modifications can be effected within the scope of the invention.

What is claimed is:

1. An airgun comprising:

a tube fork having front face with a port from which a compressed gas can flow;

a barrel having a passageway through the barrel with an opening at a back barrel face with the passageway sized to receive a projectile;

a pivot joining the barrel to the tube fork such that the barrel can be moved between a firing position where the opening is positioned to receive compressed gas and a cocking position;

a sled movable between a forward position and a retracted position;

a mechanism converting pivotal motion of the barrel relative to the fork into forces urging the sled to move toward the retracted position as the tube fork and the barrel move toward the firing position and into other forces that urge the sled to move toward the forward position as the tube fork and the barrel are rotated toward the cocking position;

a magazine holder adapted to position a magazine so that a bolt of the airgun passes through a first opening in the magazine holder, through the magazine to drive a projectile from the magazine, and through a second opening in the magazine holder as the bolt moves from the retracted position to the forward position;

a shuttle system adapted to move a projectile channel between a firing location sufficiently aligned with the barrel opening and the port to allow compressed air from the port to drive a projectile through the passageway and a loading location aligned with the second opening to allow the bolt to advance a projectile into the projectile channel; and a resilient barrier provided at the second opening having a barrier opening with at least one opening flap portion that is configured with a resilient bias that is defined so that opening flap portion applies sufficient force against a portion of the pellet to overcome any adhesion between bolt and pellet as the bolt is moved from the forward position toward the retracted position so as to hold the pellet within the shuttle.

2. The airgun of claim 1, wherein the opening flap portion is formed from a common resilient substrate with opening flap portion with the resilient bias of the resilient substrate providing the biasing force.

3. The airgun of claim 1, wherein the bias of the opening flap portion is supplied by a spring.

4. The airgun of claim 1, wherein the bolt has a tip portion with a width defined to engage a pellet generally along a back perimeter of a skirt of the pellet.

5. The airgun of claim 1, wherein bolt is sized to engage pellet along the back perimeter of a skirt of a pellet to limit the extent of adhesion and by limiting the extent of the contact area between the bolt and skirt.

6. The airgun of claim 1, wherein a plurality of opening flap portions is provided and arranged to create an inner diameter that is smaller than an outer diameter of a back perimeter of a pellet.

* * * * *